US007380889B2

(12) United States Patent
Frear

(10) Patent No.: US 7,380,889 B2
(45) Date of Patent: Jun. 3, 2008

(54) TOOL RETAINER

(76) Inventor: Joseph K. Frear, 233 North St., Bedford, PA (US) 15522

( * ) Notice: Subject to any disclaimer, the term of this patent is extended or adjusted under 35 U.S.C. 154(b) by 64 days.

(21) Appl. No.: 10/886,207

(22) Filed: Jul. 7, 2004

(65) Prior Publication Data

US 2006/0006727 A1 Jan. 12, 2006

(51) Int. Cl.
*E21C 35/197* (2006.01)

(52) U.S. Cl. ..... 299/107; 299/106

(58) Field of Classification Search ..... 299/100–113; D8/394–395; 24/673, 27, 546, 547, 648, 24/669; 403/154–155, 329; 37/455–459; 172/750; 285/305, 321; 411/517, 530
See application file for complete search history.

(56) References Cited

U.S. PATENT DOCUMENTS

| | | | | | |
|---|---|---|---|---|---|
| 27,514 | A | * | 3/1860 | Macintosh | 12/104.5 |
| 630,176 | A | | 8/1899 | Brown | |
| 1,044,299 | A | | 11/1912 | Trundle | |
| 1,310,587 | A | * | 7/1919 | Sumersille | 24/67.9 |
| 1,348,434 | A | | 8/1920 | Marshick | |
| D84,353 | S | * | 6/1931 | Larter | D19/36 |
| 1,871,839 | A | | 8/1932 | Carter | |
| 2,353,561 | A | | 7/1944 | Hassett | |
| 2,642,638 | A | * | 6/1953 | Larrabee | 24/67.9 |
| 2,908,954 | A | * | 10/1959 | Chaun | 24/67.9 |
| 3,171,666 | A | | 3/1965 | Benjamin et al. | |
| 3,268,260 | A | * | 8/1966 | Snipe | 299/107 |
| 3,314,696 | A | * | 4/1967 | Ferguson et al. | 285/148.14 |
| 3,320,575 | A | | 5/1967 | Brown et al. | |
| 3,339,944 | A | | 9/1967 | Poague | |
| 3,498,677 | A | * | 3/1970 | Morrow | 299/102 |
| 3,519,309 | A | | 7/1970 | Engle et al. | |
| 3,521,342 | A | | 7/1970 | Van Dorn et al. | |
| 3,527,120 | A | | 9/1970 | Duer et al. | |
| 3,538,940 | A | * | 11/1970 | Graham | 137/271 |
| 3,541,882 | A | | 11/1970 | Testa | |
| 3,560,027 | A | * | 2/1971 | Graham | 285/130.1 |
| 3,622,206 | A | * | 11/1971 | Krekeler | 299/109 |
| 3,652,130 | A | | 3/1972 | Elders | |
| 3,690,728 | A | * | 9/1972 | Krekeler | 299/109 |
| 3,753,582 | A | | 8/1973 | Graham | |

(Continued)

FOREIGN PATENT DOCUMENTS

DE 3712427 A1 10/1988

(Continued)

OTHER PUBLICATIONS

U.S. Appl. No. 10/917,084, Unpublished, Frear.

*Primary Examiner*—Sunil Singh
(74) *Attorney, Agent, or Firm*—Kirkpatrick & Lockhart Preston Gates Ellis LLP

(57) ABSTRACT

A retainer system for a cutting tool that has an elongated shank. In one embodiment, the retainer system includes a tool holder block that has a sleeve-receiving hole therethrough for receiving a sleeve therein. The sleeve may have a shank-receiving hole and at least one undercut portion therein. The retainer may define a shank-receiving opening and have retainer portions that correspond to each of the undercut portions in the sleeve for selective retaining engagement therewith. The first and second retainer portions retainingly engage a portion of the elongated shank of the cutting tool when inserted into the shank-receiving opening therebetween.

14 Claims, 13 Drawing Sheets

U.S. PATENT DOCUMENTS 3,767,266 A 10/1973 Krekeler
3,807,776 A 4/1974 Bingham
3,841,708 A * 10/1974 Kniff et al. ..... 299/104
3,856,359 A * 12/1974 Krekeler ..... 299/104
3,865,437 A 2/1975 Crosby
3,957,385 A 5/1976 Ullberg
3,976,340 A 8/1976 Pitner
3,980,325 A 9/1976 Robertson
4,009,896 A * 3/1977 Brewer ..... 285/305
4,049,297 A 9/1977 Reneau
4,084,856 A 4/1978 Emmerich et al.
4,229,025 A 10/1980 Volgstadt et al.
4,239,318 A 12/1980 Schwartz
4,240,677 A 12/1980 Payne et al.
4,247,147 A 1/1981 Rettkowski
4,323,727 A 4/1982 Berg
4,349,050 A 9/1982 Bergstrom et al.
4,367,053 A 1/1983 Stratienko et al.
4,484,783 A 11/1984 Emmerich
4,505,058 A * 3/1985 Peterson ..... 37/459
4,575,156 A 3/1986 Hunter et al.
4,575,456 A 3/1986 Hayes
4,616,948 A 10/1986 Jelfs
4,712,811 A 12/1987 Wier
4,733,987 A * 3/1988 Tomlinson et al. ..... 403/326
4,763,956 A * 8/1988 Emmerich ..... 299/107
4,772,139 A 9/1988 Bretton
4,813,808 A 3/1989 Gehrke
4,828,327 A 5/1989 Wechner
4,836,614 A 6/1989 Ojanen
4,850,649 A 7/1989 Beach et al.
4,915,455 A 4/1990 O'Neill et al.
4,932,689 A 6/1990 Bradley
4,944,560 A 7/1990 Osterwise
4,979,911 A 12/1990 Spencer
5,011,229 A 4/1991 O'Neill et al.
5,088,797 A 2/1992 O'Neill
5,106,166 A 4/1992 O'Neill
5,302,005 A 4/1994 O'Neill
5,354,068 A 10/1994 Maleski
5,370,448 A * 12/1994 Sterwerf, Jr. ..... 299/107
5,450,657 A 9/1995 Georgopoulos et al.
5,529,384 A 6/1996 Ojanen et al.
5,628,549 A * 5/1997 Ritchey et al. ..... 299/104
5,690,393 A 11/1997 Massa et al.
5,704,100 A * 1/1998 Swan ..... 24/656
5,725,283 A 3/1998 O'Neill
5,816,627 A 10/1998 Readman
5,931,542 A 8/1999 Britzke et al.
6,070,945 A * 6/2000 Ritchey et al. ..... 299/107
6,095,713 A 8/2000 Doyle et al.
6,357,832 B1 3/2002 Sollami
6,361,243 B1 3/2002 Geib
6,386,596 B1 * 5/2002 Olson ..... 285/321
6,585,327 B2 7/2003 Sollami
6,623,084 B1 9/2003 Wasyleczko
6,648,514 B2 11/2003 Cevasco et al.
6,681,458 B2 1/2004 Seymour
6,712,431 B1 * 3/2004 Bosch et al. ..... 299/104
2003/0052484 A1 * 3/2003 Rautureau ..... 285/305
2004/0051313 A1 * 3/2004 Trouyet ..... 285/305

FOREIGN PATENT DOCUMENTS

DE 19809344 * 6/1999
DE 100 40 562 C2 3/2002
DE 10040562 A1 3/2002

* cited by examiner

TOOL RETAINER

BACKGROUND

1. Field of the Invention

Various embodiments of the subject invention relate to tool retainers and tool retainer systems and, more particularly, to retainers for detachably retaining a cutting tool and a sleeve within a support member.

2. Description of the Invention Background

Over the years, man has designed a variety of different tools for cutting materials. One such tool is employed in the mining of underground material such as coal and the like. The tools, commonly referred to as "cutting bits", are affixed to rotating cutting drums located on mining machines. As the cutting bits are advanced into the material to be mined, the cutting bits dislodge the material from the seam to enable it to be collected on a conveyor arrangement for removal from the mine. Each such cutting bits commonly has an elongated cylindrical shank portion that is received in a mounting block that is attached to the driven cutting drum. A replaceable cutting insert, fabricated from hardened material, is usually affixed to the end of the cutting bit. In many applications, wear sleeves are employed to support the cutting bit within the support member and to reduce the wear experienced by the support member resulting from continuous operation.

A variety of bit retainer methods and systems have been designed. Examples of such retainer arrangements are disclosed in U.S. Pat. No. 3,519,309 to Engle et al., U.S. Pat. No. 4,084,856 to Emmerich et al, U.S. Pat. No. 4,484,783 to Emmerich, and U.S. Pat. No. 4,247,147 to Rettkowski.

SUMMARY

In accordance with one embodiment of the invention, there is provided a retainer system for a cutting tool that has an elongated shank. In this embodiment, the retainer system may include a tool holder block that has a sleeve-receiving hole therethrough for removably receiving a sleeve therein. The sleeve may have a shank-receiving hole and at least one undercut portion therein. Also in this embodiment, a retainer that has a first retainer portion and a second retainer portion that overlaps at least a part of the first retainer portion may be employed. The first and second retainer portions may define a shank-receiving opening therebetween. At least a portion of the retainer corresponds to each of the undercut portions in the sleeve for selective retaining engagement therewith. The first and second retainer portions retainingly engage a portion of the elongated shank of the cutting tool when inserted into the shank-receiving opening therebetween.

Another embodiment of the present invention comprises a retainer for retaining a shank of a cutting tool within a sleeve. In this embodiment, the retainer comprises a spring member that has a first sleeve-engaging portion biasingly received within a first undercut portion in the sleeve and a second sleeve-engaging portion biasingly received within a second undercut portion in the sleeve. The retainer further has a first shank-engaging portion and a second shank-engaging portion opposite from the first shank-engaging portion to define a shank-receiving opening therebetween. The first and second shank-engaging portions serve to retainingly engage the shank when the shank is received in the shank-receiving opening.

Another embodiment of the present invention comprises a retainer for retaining a first member that has an elongated shank within a second member. In this embodiment, the retainer comprises a spring member that has a first retaining portion that is biasingly received within a first undercut portion in the second member and a second retaining portion that is biasingly received within a second undercut portion in the second member. The retainer further comprises a first shank-engaging portion and a second shank-engaging portion that is opposite from the first shank-engaging portion to define a shank-receiving opening therebetween. The first and second shank engaging portions retainingly engage the shank when the shank is received in the shank-receiving opening.

Another embodiment of the present invention comprises a retainer system for a cutting tool that has an elongated shank. The retainer system comprises a tool holder block that has a sleeve-receiving hole therethrough. A sleeve is removably received in the sleeve-receiving hole in the tool holder block. The sleeve has a shank-receiving hole and at least one undercut portion therein. This embodiment of the system further includes means for retaining the sleeve within the tool holder block and for selectively retaining the shank of the cutting tool within the sleeve. The means are configured such that upon application of first and second forces to portions of the means for retaining, the shank is released from retaining engagement with the means for retaining and the means for retaining is retained in engagement with the sleeve.

Another embodiment of the present invention comprises a method for releasably retaining the shank of a cutting bit within a shank-receiving hole in a support member, wherein the support member has at least one undercut portion therein. In this embodiment, the method comprises engaging at least one retaining portion of a retainer in at least one of the undercut portions and applying opening forces to the retainer to enable the shank to be moved into a shank-receiving opening in the retainer. The method further comprises inserting the shank into the shank-receiving opening and discontinuing the application of opening forces to the retainer to permit the retainer to biasingly engage the shank.

Another embodiment of the present invention comprises a method for releasably retaining a cutting bit having an elongated shank in a support member. In this embodiment, the method comprises inserting a sleeve into a sleeve-receiving hole in the support member. The sleeve has a shank-receiving hole and at least one undercut portion therein. The method further comprises attaching a retainer to the sleeve wherein the retainer has shank-engaging portions that define a shank-receiving opening therebetween. The method also comprises inserting the shank into the shank-receiving hole in the sleeve and applying opening forces to the retainer to enable a the shank to be moved into the shank-receiving opening in the retainer. Also in this embodiment, the method includes discontinuing the opening forces to cause the retainer to retainingly engage the shank.

Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION

Figure 1:
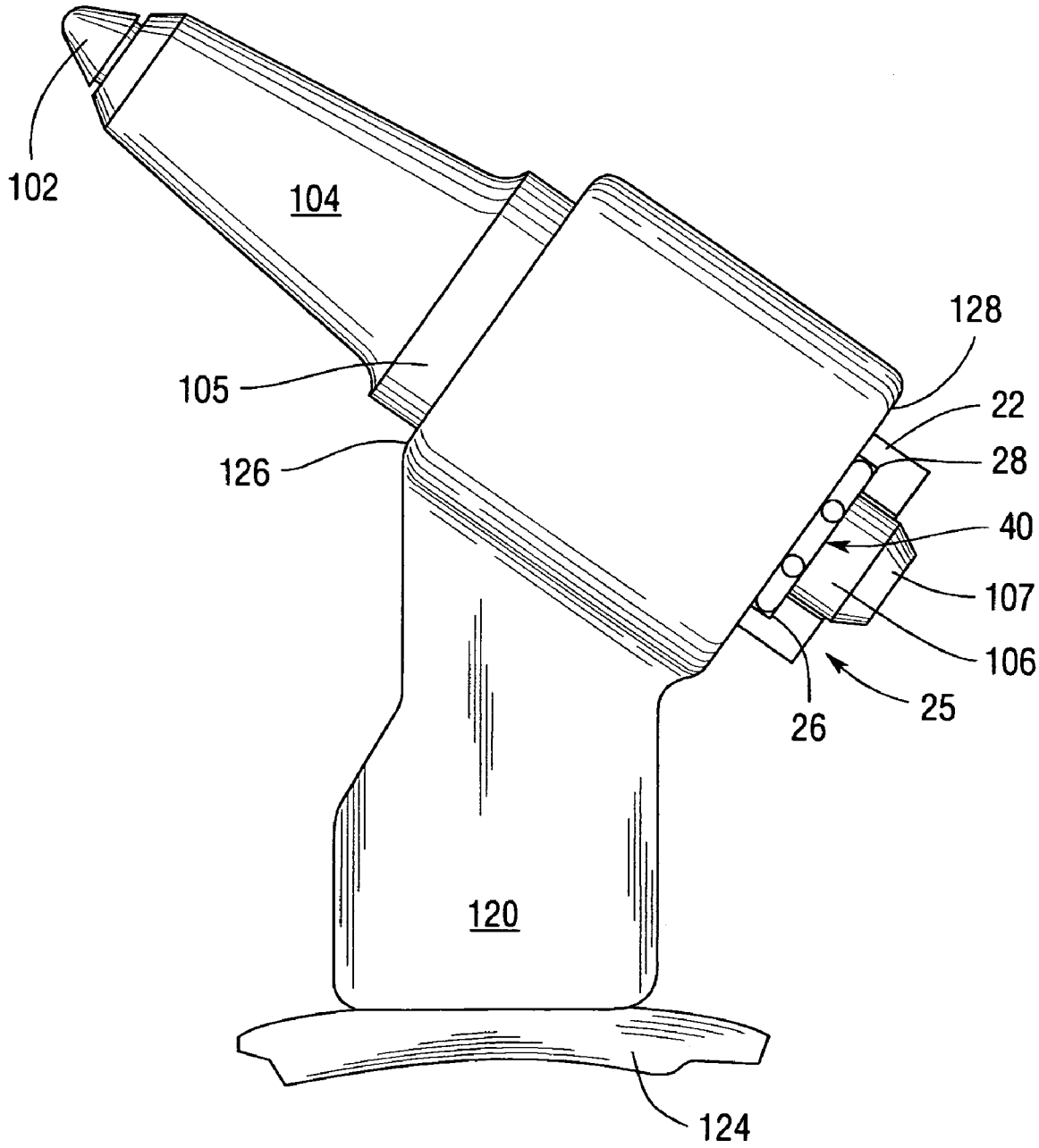
FIG. 1 is a side view of a cutting bit attached to a support member affixed to a rotatable cutting drum utilizing one embodiment of the tool retainer of the present invention.

Referring now to the drawings for the purposes of illustrating embodiments of the invention only and not for the purposes of limiting the same, FIGS. 1-8 illustrate one tool retainer system 10 of the present invention utilized to retain a cutting tool in the form of a conventional cutting bit 100 that may commonly be employed in connection with the mining of coal, minerals and the like. However, as the present Detail Description proceeds, the reader will appreciate that the various embodiments of the subject invention will find utility outside of the field of mining bits and the like. Various embodiments of the subject invention could be used with a variety of different cutting tools. For example, some, if not all, of the embodiments of the subject invention could be used in connection with cutting tools used to cut/grind road surfaces and the like. Thus, the scope of protection afforded to the various embodiments of the subject invention should not be limited solely to use with mining bits.

Figure 2:
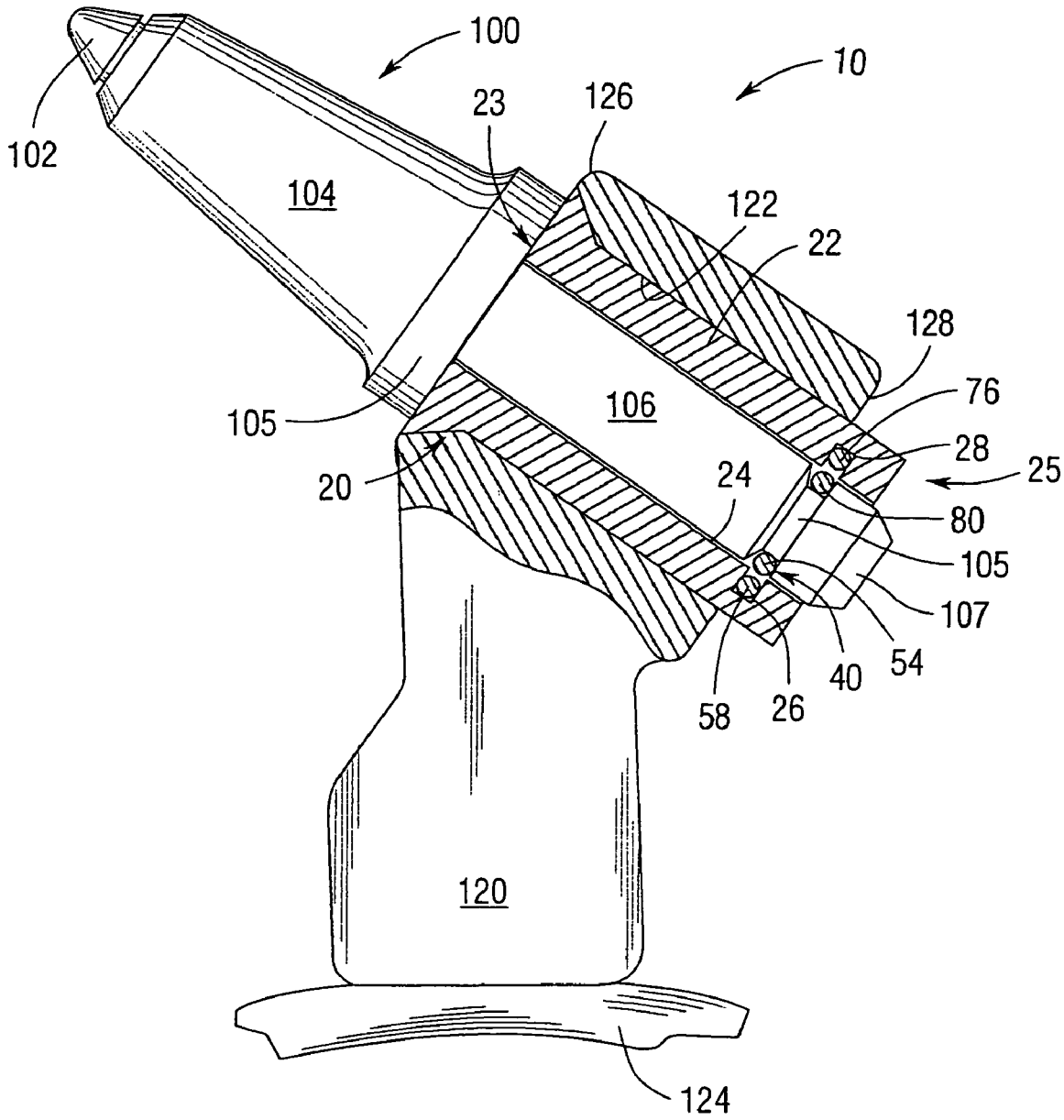
FIG. 2 is a cross-sectional view of the cutting bit and support member arrangement of FIG. 1 with some elements shown in full view for clarity.

More particularly and with reference to FIGS. 1 and 2, the conventional cutting bit 100 shown in these Figures includes a cutting tip or insert 102 that is attached to a conical portion 104. The cutting insert 102 may be fabricated from hardened material and be attached to the end of the conical portion 104 by brazing or other conventional fastening methods.

The cutting bit 100 further has an elongated shank 106 which is commonly cylindrical in shape and designed to be supported in a tool holder block or support block 120 that is attached to a rotatable cutting drum 124 which is operably supported on a mining machine (not shown). It will be understood that when the rotating cutting bit 100 is brought into contact with the material to be mined, the cutting tip 102 of the cutting bit 100 dislodges the material from the seam to enable it to drop onto a conveying system for removal from the mine. As the present Detailed Description proceeds, the reader will appreciate that various retainer system embodiments of the present invention may be effectively used in connection with a variety of different types and shapes of cutting bits, tools, etc. without departing from the spirit and scope of the present invention. Furthermore, the various retainer system embodiments of the present invention can also be effectively used to removably affix a first member that has an elongated shank or similar portion to a second member. Accordingly, the scope of protection afforded to these various embodiments should not be limited solely to use in connection with cutting bits having the specific shape and characteristics of the one cutting bit example depicted in FIGS. 1 and 2.

Because the cutting bits 100 from time to time become damaged and dull from operation, it is desirable to be able to remove the cutting bits 100 from the support block 120 so that they may be replaced with new or refurbished cutting bits with minimal downtime to the mining operation. Furthermore, because it generally is more time consuming to replace damaged support blocks 120, replaceable wear sleeves 20 may be used to protect and prolong the useful lives of the support blocks 120.

Figure 6:
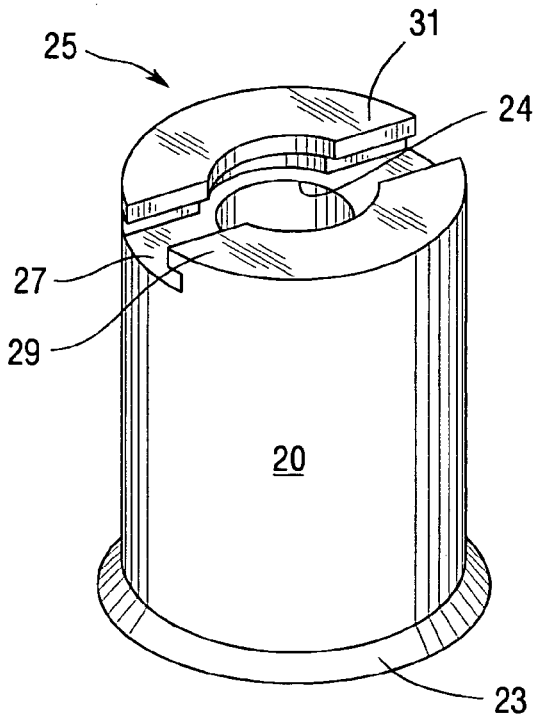
FIG. 6 is a perspective view of a sleeve embodiment of the present invention.
Figure 7:
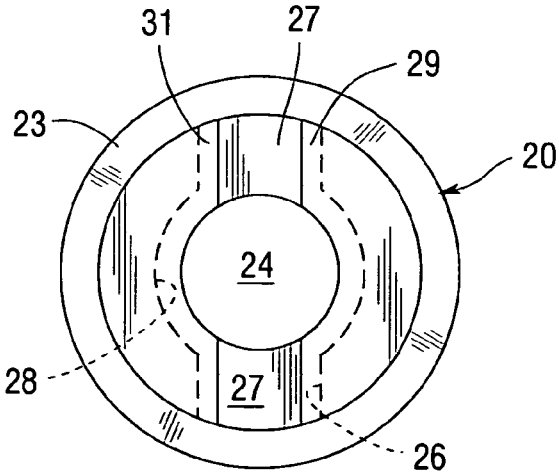
FIG. 7 is a top view of the sleeve of FIG. 6.
Figure 8:
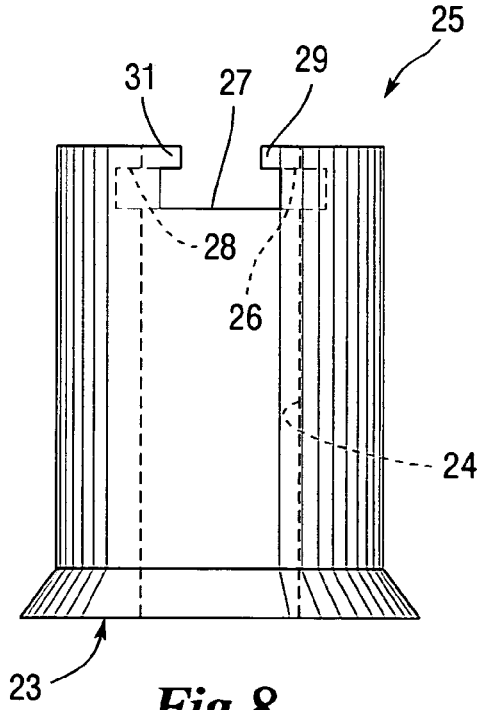
FIG. 8 is a front elevational view of the sleeve of FIGS. 6 and 7.

In the embodiment depicted in FIGS. 1-4, the support block 120 has a front face 126 and a rear face 128. A sleeve-receiving hole 122 extends from the front face 126 to the rear face 128 for receiving a wear sleeve 20 therein. FIGS. 6-8 illustrate one sleeve embodiment of the present invention. The wear sleeve 20 may be fabricated from, for example, metal, steel, plastic, etc. and have a cylindrical shaped body 22 with a chamfered forward end 23 and a rearward end 25. A shank-receiving hole 24 extends through the sleeve 20 from the forward end 23 to the rearward end 25 and is sized to receive the shank 106 of the cutting bit 100 therein. Also in this embodiment, the rearward end 25 of the sleeve 20 has opposed undercut portions 26, 28 therein which serve to define retaining flanges 29, 31, respectively. See FIGS. 3, 7 and 9.

In this embodiment, the sleeve 20 is inserted into the sleeve-receiving hole 122 in the support block 120 such that the outer surface of the forward end 23 is essentially flush with the front face 126 of the support block 120. The shank 106 of the cutting bit 100 has a necked-down portion 105 that registers with the undercut portions or grooves 26 and 28 when the shank 106 is fully received within the shank-receiving hole 24 in the sleeve 20 as shown in FIG. 2.

Figure 3:
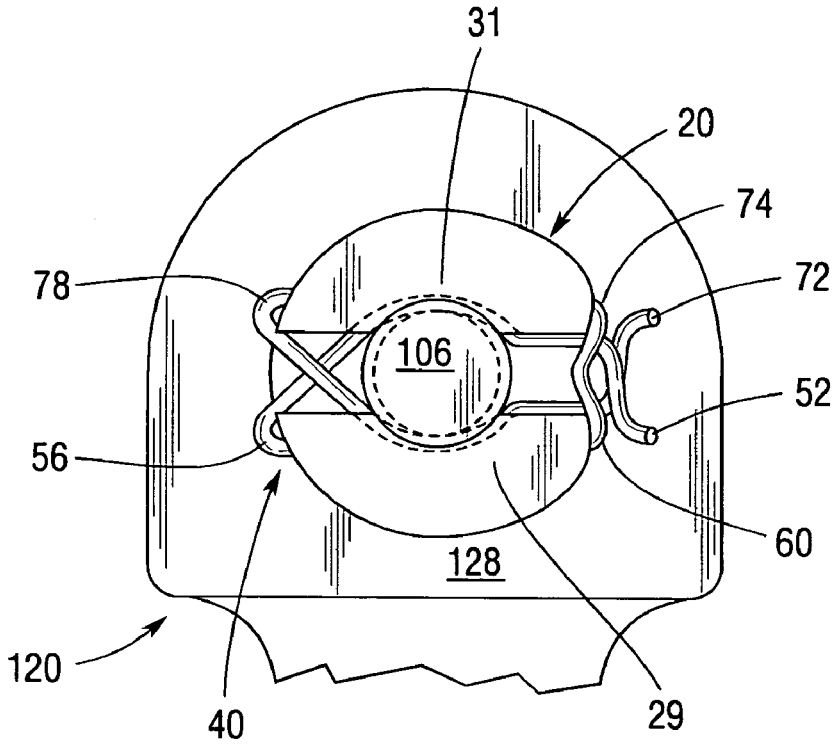
FIG. 3 is a partial end view of the support member and cutting bit assembly depicted in FIGS. 1 and 2.
Figure 4:
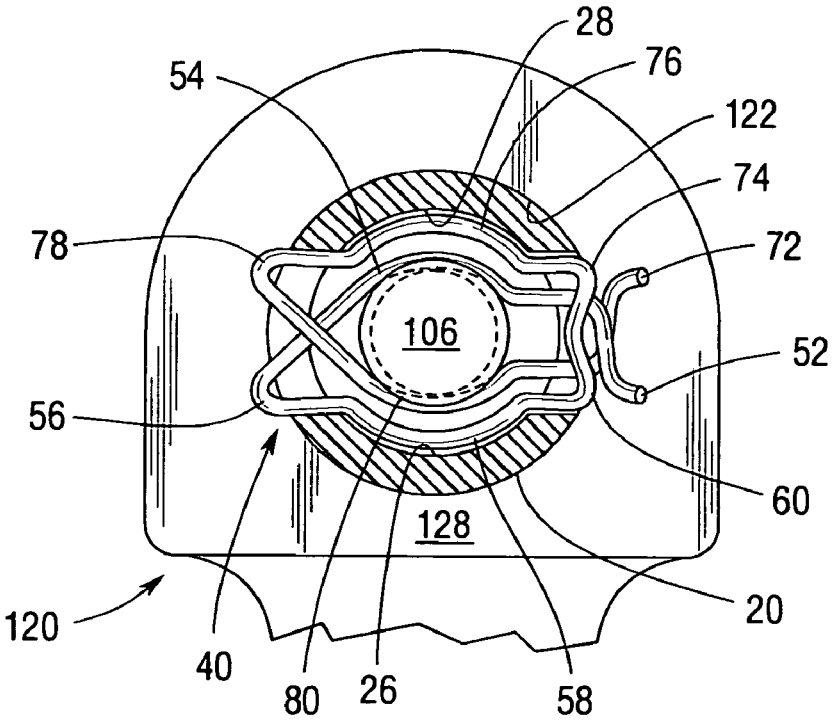
FIG. 4 is another end view of the support member and cutting bit assembly depicted in FIG. 3 with the sleeve shown in cross-section for clarity.
Figure 5:
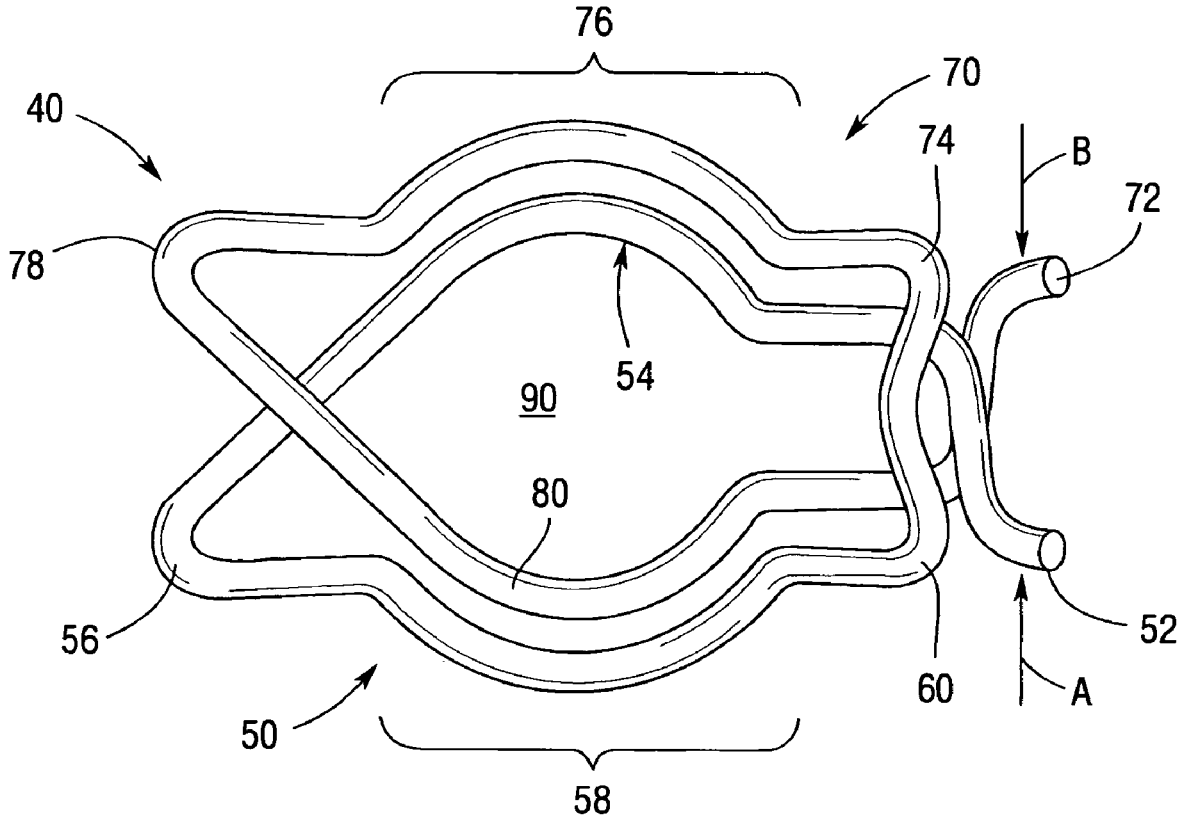
FIG. 5 is an enlarged plan view of an embodiment of a retainer spring of the present invention.

Also in this embodiment, to retain the sleeve 20 within the support block 120 and the cutting bit 100 within the sleeve 20, a unique and novel spring retainer 40 is employed. The spring retainer 40 may be fabricated from, for example, steel, other metals, plastic, etc. As can be seen in FIG. 5, the spring retainer 40 may be formed from a single piece of spring wire and be configured such that it has a first portion 50 and a second portion 70 that essentially overlaps portions of the first portion 50. The first portion 50 terminates in a first upturned end 52 and the second portion 70 terminates in a second upturned end 72. The first portion 50 includes a first semi-arcuate shank-engaging portion 54 and is bent to form a first retaining node 56 that is transversely opposite to the first upturned end 52. As used herein, the term "node" refers to a bent portion or otherwise configured portion of the retainer spring 40. The retainer spring 40 is also configured with a first semi-arcuate sleeve-engaging portion 58 and a primary retaining node 60 that is substantially transversely opposite from the first retaining node 56. As shown in FIGS. 3-5, a secondary retaining node 74, which is part of the retainer spring 40 that has been designated as the second portion 70, is formed adjacent the primary retaining node 60. The second portion 70 further includes a second semi-arcuate sleeve-engaging portion 76 and then forms a second retaining node 78 that is transversely opposite from the secondary retaining node 74. The second portion 70 further includes a second semi-arcuate shank engaging portion 80 that cooperates with the first semi-arcuate shank engaging portion 54 to define a shank-receiving opening 90 therebetween. This portion of retainer spring 40 then passes under the first upturned end 52 to terminate in the second upturned end 72.

Figure 8A:
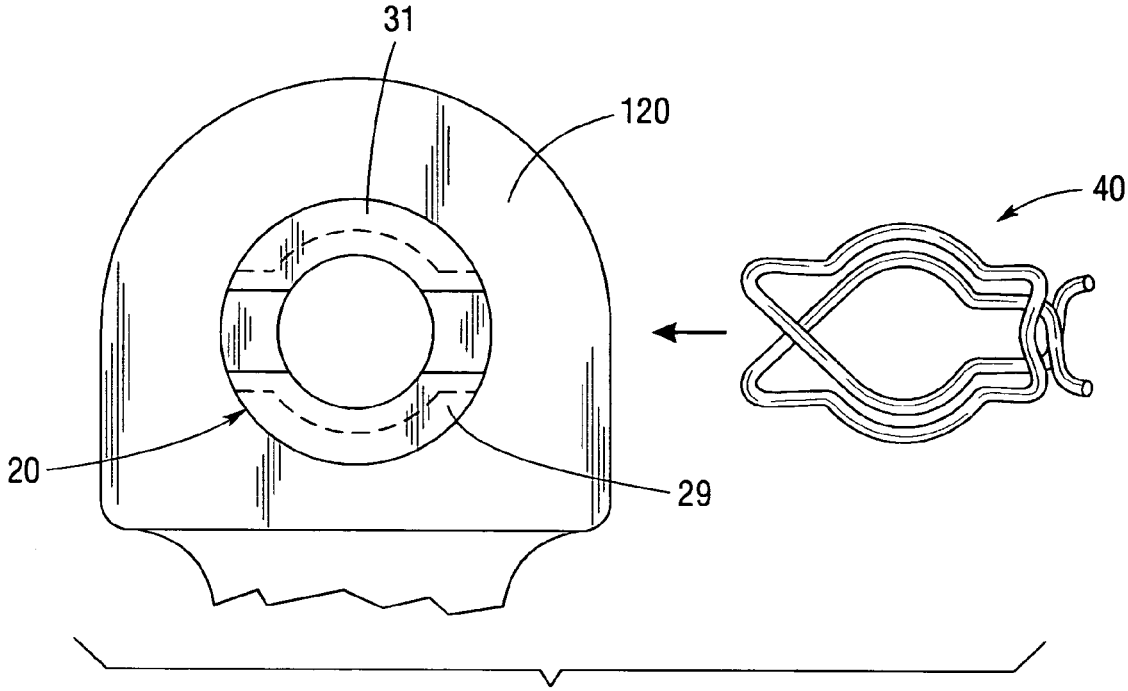
FIG. 8A is a partial exploded assembly view of on embodiment of the retainer spring of the present invention and a sleeve received within the sleeve-receiving hole in a support block.

The retainer spring 40 can be used to removably retain the sleeve 20 within the sleeve-receiving hole 122 in the support block 120 and removably retain the shank 106 of the cutting bit 100 in the shank-receiving hole 24 in the following manner. The retainer spring 40 is attached to the rearward end 25 of the sleeve 20 by inserting the first sleeve-engaging portion 58 into the first undercut portion or groove 26 in the sleeve 20 and the second sleeve-engaging portion 76 into the second undercut portion or groove 28. See FIG. 8A. It will be understood that the shape of the retainer spring 40 serves to bias the first and second sleeve engaging portions 58, 76 in opposing directions and into retaining engagement with the undercut portions or grooves 26, 28, respectively. The first retainer flange 29 serves to retain the first sleeve-engaging portion 58 in biasing retaining engagement with the first undercut portion or groove 26 and the second retainer flange 31 serves to retain the second sleeve engaging portion 76 in biasing retaining engagement with the second undercut portion or groove 28. See FIGS. 1-3.

After the retainer spring 40 has been attached to the sleeve 20, the end 107 of the shank 106 is inserted into the shank-receiving hole 24 in the sleeve 20. In one embodiment, the end 107 of the shank 106 has a chamfered surface 107 such that when it first contacts the first and second shank-engaging portions 54, 80, the chamfered end 107 causes the first and second shank-engaging portions 54, 80 to spread open to permit the shank 106 to pass therethrough until the groove 105 is in registry with the undercut portions or grooves 26, 28. When the groove 105 in the shank 106 is in registry with the undercut portions 26, 28, the first and second shank-engaging portions 54, 80 snap therein to retain the shank 106 within the shank-receiving hole 24 as shown in FIG. 2. Thus, when installed as shown in FIG. 2, the sleeve 20 is retained in the support block 120, by virtue of the first and second retaining nodes 56, 78 and the primary and secondary retaining nodes 60, 74 in abutting contact with the rear surface 128 of the support block 120 and its chamfered forward end 23. The cutting bit 100 is retained within the sleeve 20 by virtue of the first shank-engaging portion 54 and the second shank-engaging portion 80 in biasing engagement with the annular groove 105 in the shank 106 of the cutting bit 106. As can be seen in FIG. 2, in this embodiment, portions 54, 58, 76, 80 of the spring retainer 40 may essentially lie in a common plane.

To remove the cutting bit 100 from the sleeve 20, opposing forces represented by arrows A and B in FIG. 5 are applied to the free ends 52, 72 of the retainer spring 40 which serves to move the first and second shank-engaging portions 54, 80 out of the annular groove 105 a sufficient amount to permit the shank 106 to be withdrawn out of the shank-receiving hole 24.

As can be seen in FIG. 3, the free ends 52 and 72 are "exposed" for easy access. As used herein "exposed" means that the free ends 52 and 72 are accessible from the exterior of the sleeve 20 and support bock 120 to enable opening forces to be applied thereto. In this embodiment, by forcing the free ends 52, 72 toward each other, the first and second shank-engaging portions are moved out of retaining engagement with the shank 106 and the first and second sleeve-engaging portions 58, 76 are retainingly received in undercut portions or grooves 29, 31 to retain the spring retainer 40 in the sleeve 20.

Figure 9:
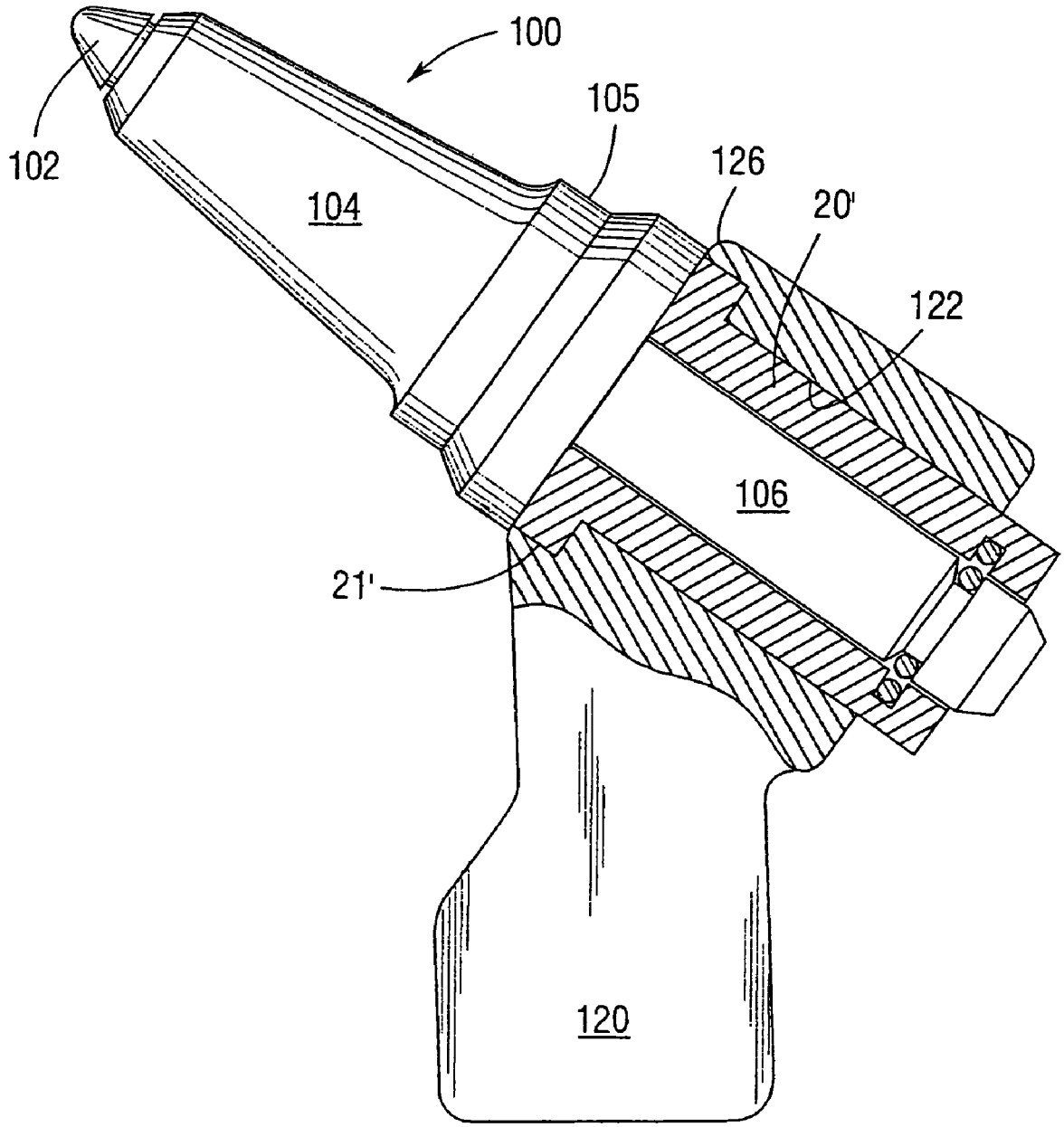
FIG. 9 is a side view of a cutting bit attached to a support member utilizing another embodiment of the tool retainer of the present invention, with some elements shown in cross-section for clarity.

Another embodiment of the tool retainer of the present invention is depicted in FIG. 9. This embodiment is substantially identical to the embodiment described above. However, in this embodiment, the sleeve 20' is provided with a flanged end 21'. Thus, when the cutting bit 100 has been removed from the sleeve 20' in the manner described above, the sleeve 20' remains attached to the support block 120. The spring retainer 40 must be removed from the sleeve 20' to enable the sleeve 20' to be removed from the support block 120. Other sleeve configurations may also be employed. For example, the sleeve may be provided with a continuous shoulder or shoulder portions to retain the sleeve within the support block when the retainer spring 40 has been installed.

Another embodiment of the retainer spring 200 of the present invention is depicted in FIGS. 10-16. This embodiment may also employ a sleeve 20 of the type that was described above. In this embodiment, the retainer spring 200 may be formed from a single piece of spring wire and be configured such that it has a first portion 210 and a second portion 230 that essentially overlaps portions of the first portion 210. The first portion 210 terminates in a first upturned end 212 and the second portion 230 terminates in a second upturned end 232. The first portion 210 includes a first semi-arcuate sleeve engaging portion 214, a first transverse retaining portion 216 and a first semi-arcuate shank-engaging portion 218. The second retaining portion 230 includes a second semi-arcuate sleeve-engaging portion 234, a second transverse retaining portion 236 and a second shank-engaging portion 238 that cooperates with the first shank-engaging portion 218 to form a shank-receiving area 240 therebetween. As shown in FIGS. 10-16, portions of the first portion 210 overlap portions of the second portion 230 of the retainer spring 200.

Figure 10A:
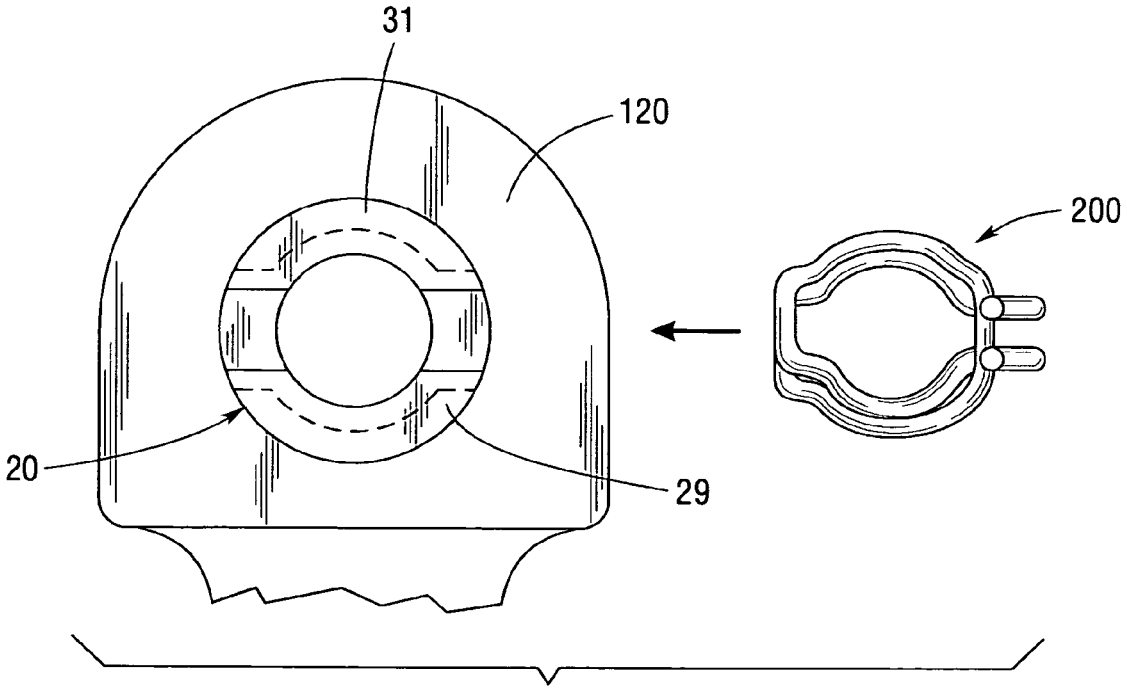
FIG. 10A is a partial exploded assembly view of another embodiment of the retainer spring of the present invention and a sleeve received within the sleeve-receiving hole in a support block.

The retainer spring 200 can be used to removably retain the sleeve 20 within the sleeve-receiving hole 122 in the support block 120 and removably retain the shank 106 of the cutting bit 100 in the shank-receiving hole 24 in the following manner. The retainer spring 200 may be attached to the rear end 25 of the sleeve 20 by inserting the first sleeve-engaging portion 214 into the first undercut portion or groove 26 in the sleeve 20 and the second sleeve-engaging portion 234 into the second undercut portion or groove 28. See FIG. 10A. It will be understood that the shape of the retainer spring 200 serves to bias the first and second sleeve engaging portions 214, 234 in opposing directions and into engagement with the second and first undercut portions or grooves 28, 26. The first retainer flange 29 serves to retain the first sleeve-engaging portion 214 in biasing engagement with the second undercut portion or groove 28 and the second retainer flange 31 serves to retain the second sleeve-engaging portion 234 in biasing engagement with the first undercut portion or groove 26 or visa versa. See FIG. 10.

Figure 10:
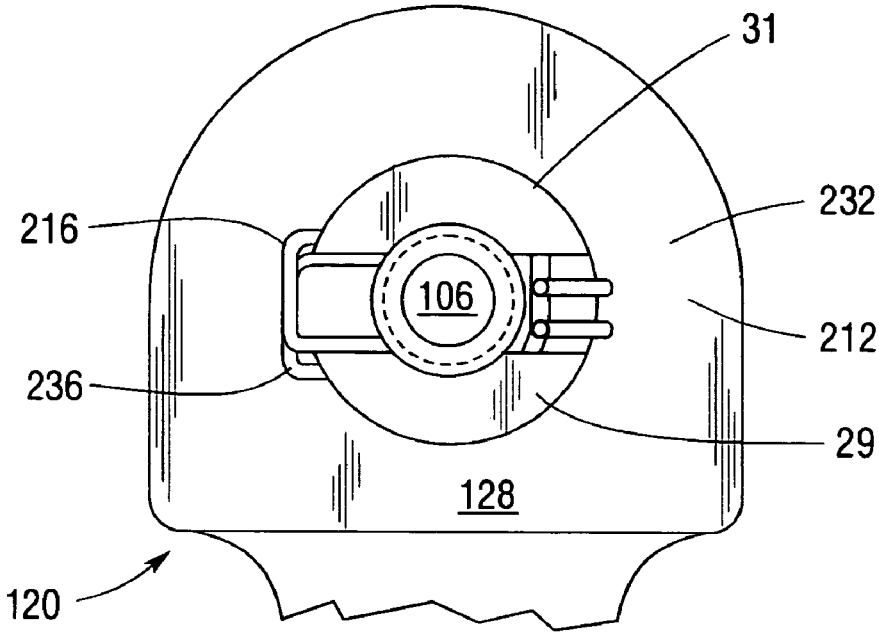
FIG. 10 is a partial end view of the support member and cutting bit assembly depicted in FIG. 9.
Figure 11:
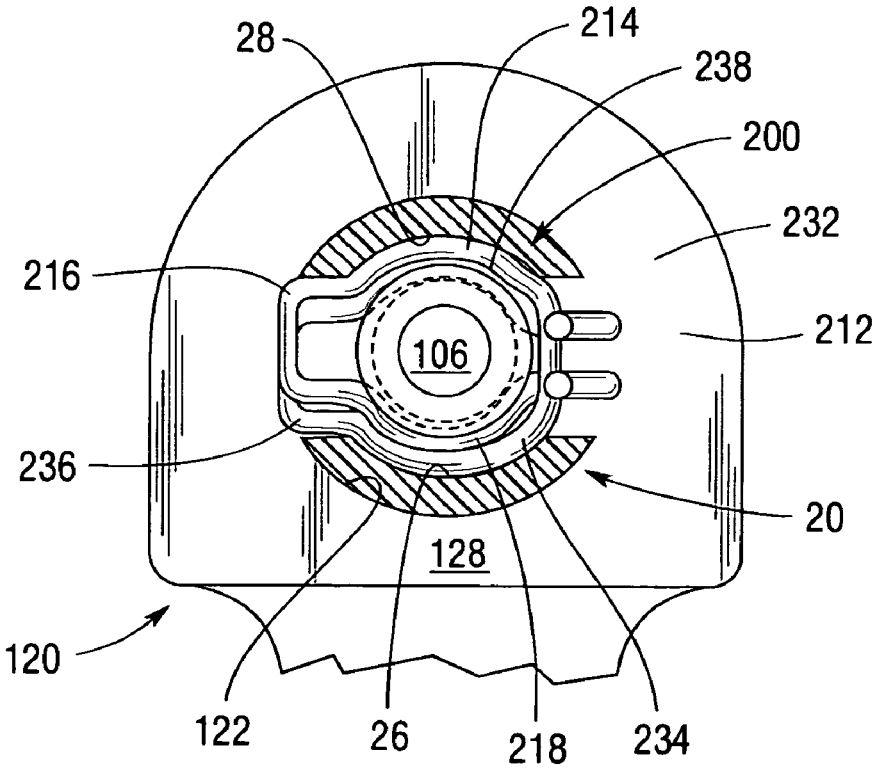
FIG. 11 is a partial end view of the support member and cutting bit assembly depicted in FIGS. 9 and 10 with the sleeve shown in cross-section for clarity.
Figure 14:
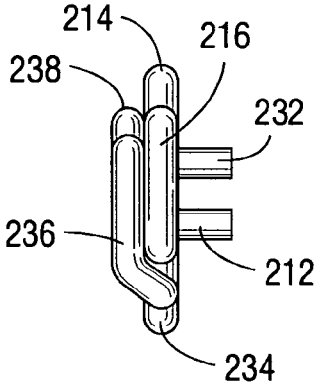
FIG. 14 is a left side elevational view of the retainer of FIGS. 12 and 13.

In this embodiment, an annular groove 105 or portions of a retaining groove are provided in a portion of the cutting bit shank 106 adjacent to the end 107 for receiving the first and second shank-engaging portions 218, 238 therein when the end 107 of the shank 106 extends through the shank-receiving opening 240 formed therebetween. Thus, when installed as shown in FIGS. 10 and 11, the sleeve 20 is retained in the support block 120 by virtue of the first and second transverse retaining portions 216, 236 and the first and second ends 212, 232 in abutting contact with the rear face 128 of the support block 120 and the first semi-arcuate sleeve engaging portion 214 in contact with the second retaining flange 31 and the second semi-arcuate sleeve-engaging portion 234 in engagement with the first retaining flange 29. The cutting bit 100 is retained within the sleeve 20 by virtue of the first shank-engaging portion 218 and the second shank-engaging portion 238 in biasing engagement with the annular groove 105 in the cutting bit shank 106.

Figure 12:
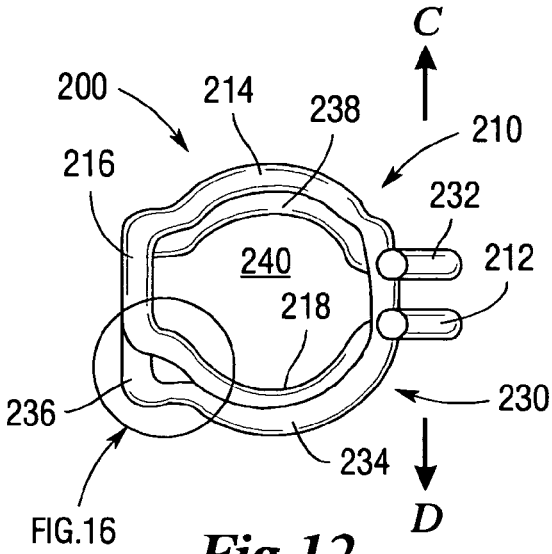
FIG. 12 is a top view of another retainer member of the present invention.
Figure 13:
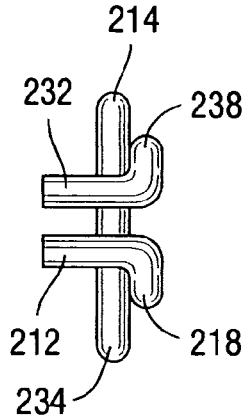
FIG. 13 is a right side elevational view of the retainer of FIG. 12.
Figure 16:
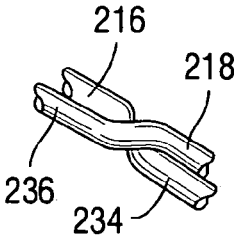
FIG. 16 is a partial side elevational view of the retainer of FIGS. 12-15.
Figure 15:
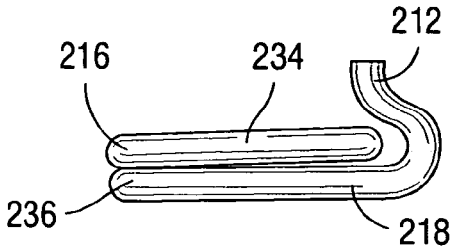
FIG. 15 is a front elevational view of the retainer of FIGS. 12-4.

To remove the cutting bit 100 from the sleeve 20, opening forces represented by arrows C and D in FIG. 12 are applied to the free ends 212, 232 of the retainer spring 40 which serve to move the first and second shank-engaging portions 218, 238 out of engagement with the annular groove 105 in the cutting bit shank 106 to thereby enable the cutting bit shank 106 to be pulled out of the shank-receiving opening 24 in the sleeve 20. Thus, in this embodiment, by forcing the free ends 212, 232 away from each other, the first and second shank-engaging portions are 218, 238 moved out of engagement with the shank 106, while the first and second sleeve engaging portions 214, 234 are retained in retaining engagement with the undercut portions 26, 28 of the sleeve 20. In this embodiment, once the cutting bit 100 has been removed, the sleeve 20 with the spring retainer 200 attached may be slid out of the back of the support block 120. The reader will appreciate that this embodiment may also be used in connection with a sleeve 20' as depicted in FIG. 9.

Figure 17:
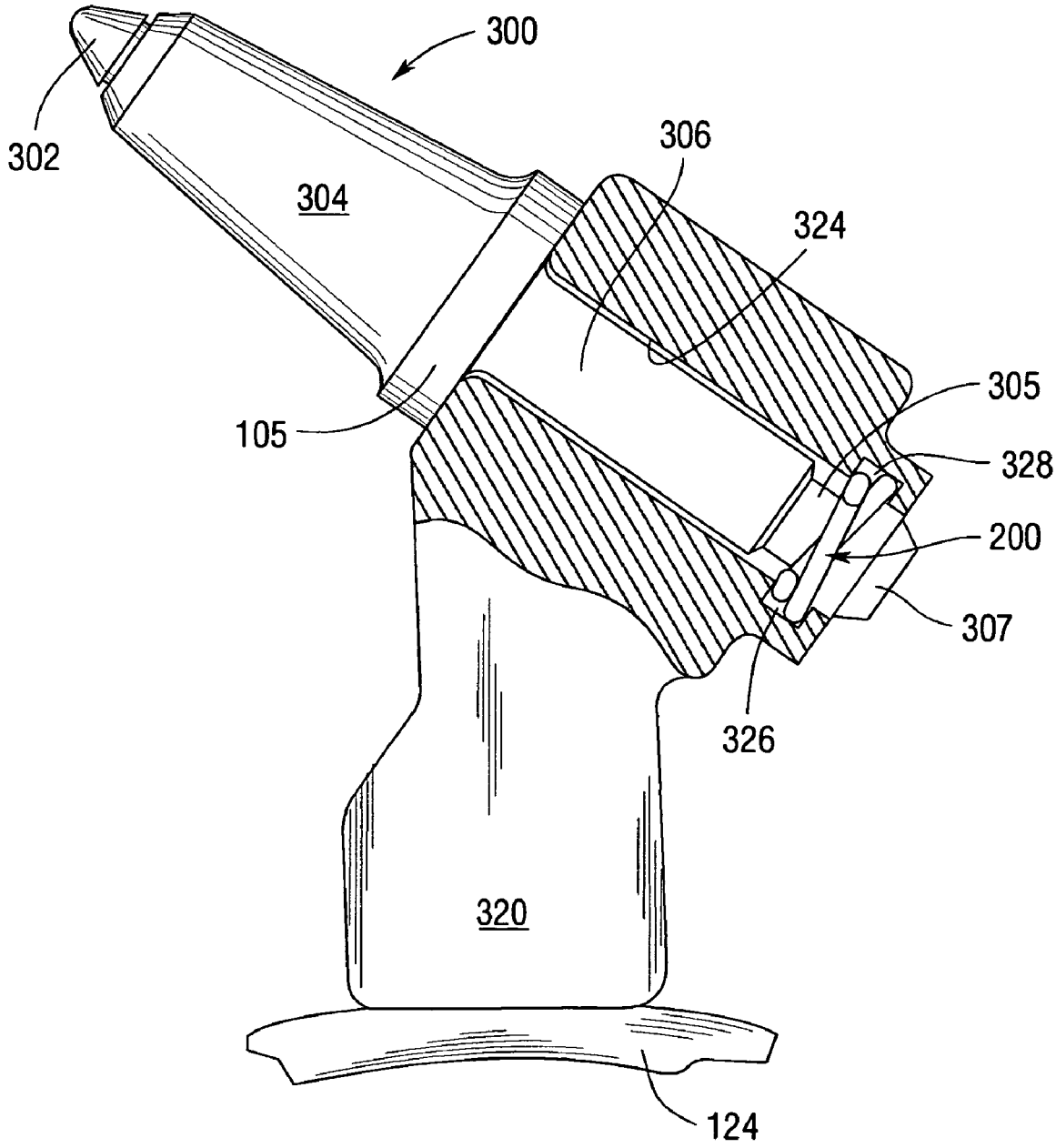
FIG. 17 is a side view of a cutting bit attached to a support member affixed to a rotatable cutting drum utilizing another embodiment of the tool retainer system of the present invention.

FIG. 17 illustrates another embodiment of the tool retainer system of the present invention. As can be seen in that Figure, undercut portions or grooves 326 and 328 are provided in the support block 320 which is otherwise similar in construction and operation as support block 120 described above. The cutting bit 300 has a shank 306 that is received within the shank-receiving hole 324 in the support block 320. The bit may otherwise be constructed in one of the various manners described above and include, for example, a conical portion 304 and a cutting insert 302. In this embodiment, the shank 306 has a necked-down portion 305 and chamfered end 307. A retainer spring 40 or 200 of the types and constructions described above, may be employed in the manner described above to retain the bit within the support block 320. See FIG. 17.

Figure 18:
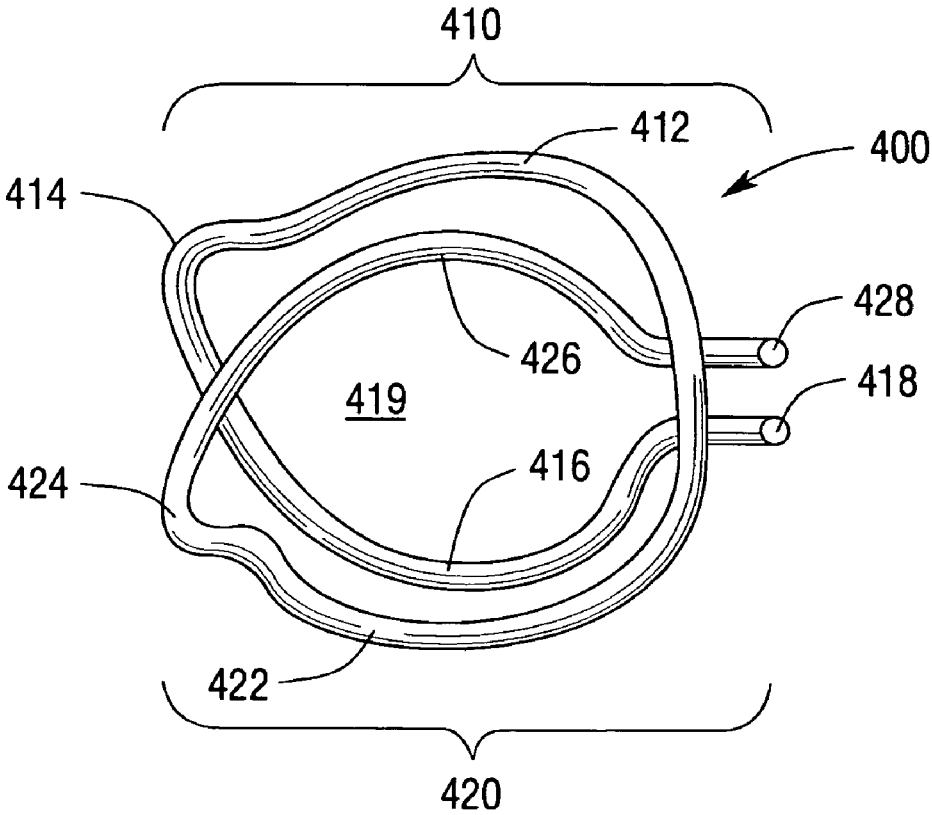
FIG. 18 is a plan view of another spring retainer embodiment of the present invention.
Figure 19:
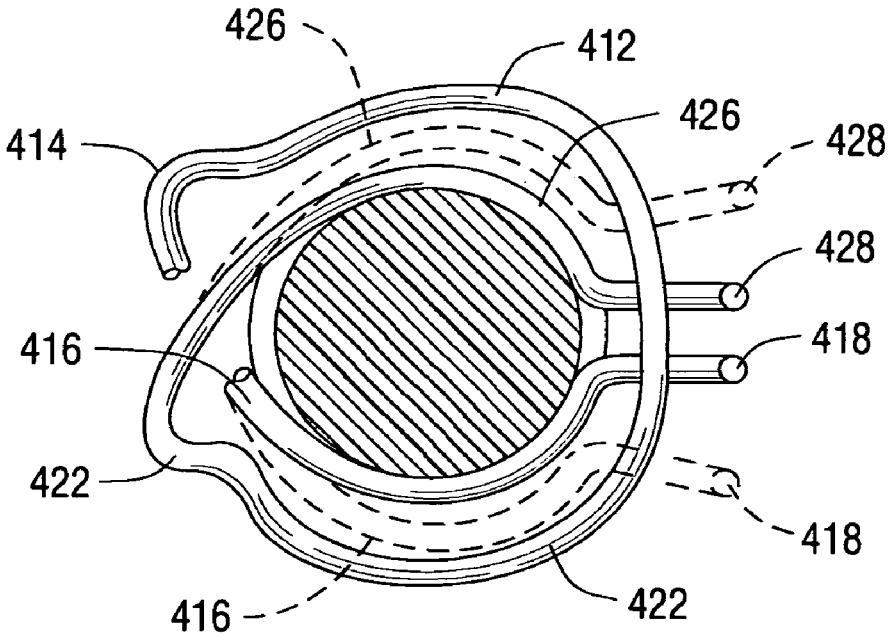
FIG. 19 is a plan view of the spring retainer embodiment of FIG. 18 attached engaging a shank of a bit shown in cross-section and illustrating movement of the free ends of the retainer in broken lines.
Figure 20:
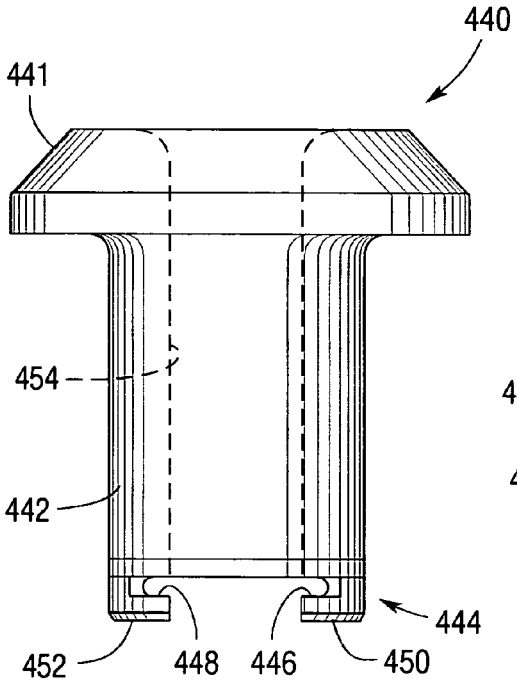
FIG. 20 is an elevational view of another sleeve embodiment of the retainer system of the present invention.

Another retainer spring embodiment of the present invention is depicted in FIGS. 18 and 19. In this embodiment, the retainer spring 400 may be fabricated from a single piece of spring wire or the like and have first portion generally designated as 410 and a second portion generally designated as 420. The first portion 410 includes a sleeve-engaging portion 412, a retaining node 414 and a shank-engaging portion 416. The first portion 410 also includes a first end 418. The second portion 420 may include a second sleeve-engaging portion 422, a second node or bent portion 424 and a second shank-engaging portion 426. The second portion 420 also includes a second free end 428. The second shank-engaging portion 426 cooperates with the first semi-arcuate shank engaging portion 416 to define a shank-receiving opening 419 therebetween. The retainer spring 400 may be attached to one of the sleeve embodiments described above. FIG. 19 illustrates in broken lines the movement of the first and second ends 418, 428 between an engaged position wherein the retainer spring 400 is in engagement with the groove 105 in the shank 106 of a bit 100 and disengaged or open positions wherein the shank may be removed from the sleeve 20.

By way of example, the spring retainer 400 may be employed in connection with a sleeve 440 and a support block 460. More specifically and with reference to FIGS. 20-23, the sleeve 440 may have a flanged first end 441 and a shank 442 that has a second retaining end 444. First and second undercut portions or grooves 446, 448 are provided in the sleeve 440 adjacent the second retaining end 444. The first undercut portion or groove 446 serves to define a first retaining flange 450 and the second undercut portion or groove 448 defines a second retaining flange 452. A shank-receiving hole 454 extends axially through the sleeve 442.

Figure 22:
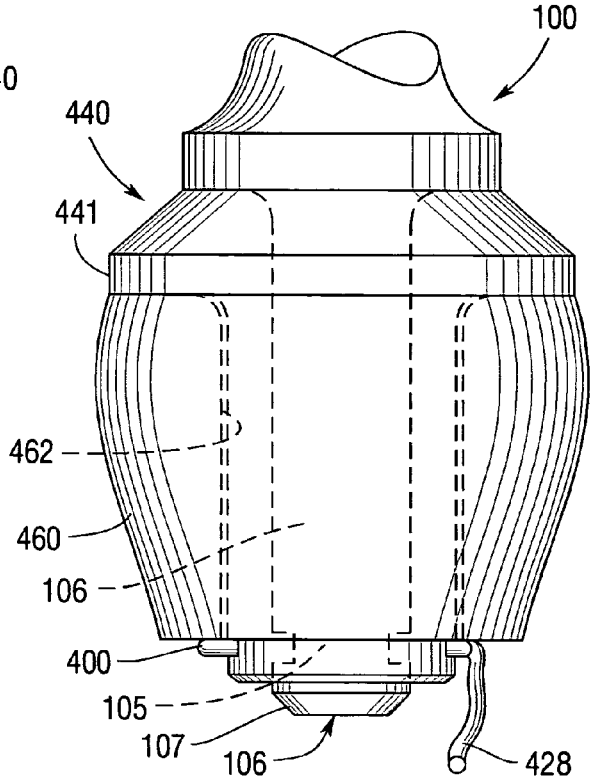
FIG. 22 is a side view of the sleeve of FIGS. 20 and 21 installed in another support block embodiment of the present invention utilizing one spring retainer embodiment of the present invention.
Figure 21:
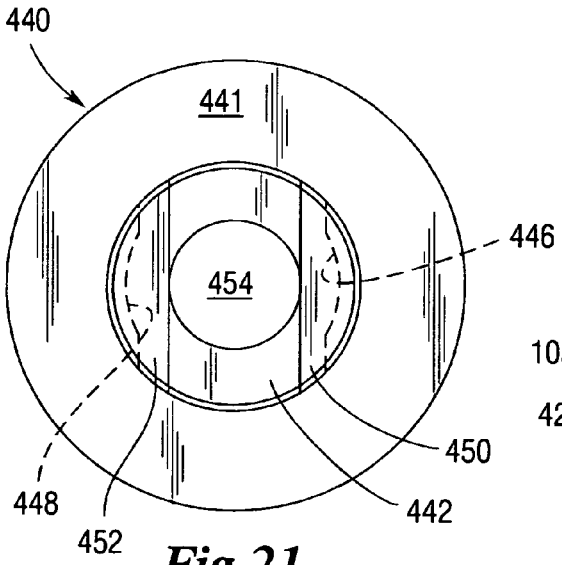
FIG. 21 is a bottom view of the sleeve of FIG. 20.
Figure 23:
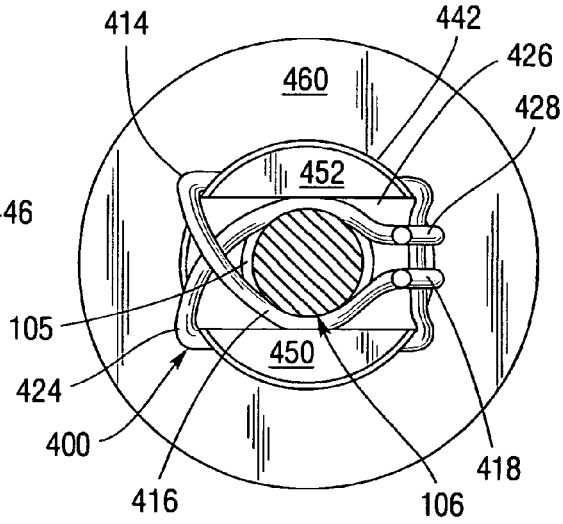
FIG. 23 is a bottom view of the assembly depicted in FIG. 22.

As shown in FIGS. 22 and 23, a retainer spring 400 may be employed to retain the sleeve 440 in a sleeve-receiving hole 462 in the support block 460. In particular, the first sleeve-engaging portion 412 is arranged to be received within the first undercut portion or groove 446 and the second sleeve-engaging portion 422 is inserted into the second undercut portion or groove 448. The shank 106 of a bit 100 is inserted into the shank-receiving hole 454 in the sleeve 440 and into the shank-receiving opening 419 to enable the first and second shank-engaging portions 424, 426 of the retainer spring 400 to snap into the groove 105 in the shank 106 to retain the bit 100 in the sleeve 440 and support block 460. The ends 418 and 428 are exposed to provide easy access thereto for removing the bit 100 from the sleeve 440.

Figure 24:
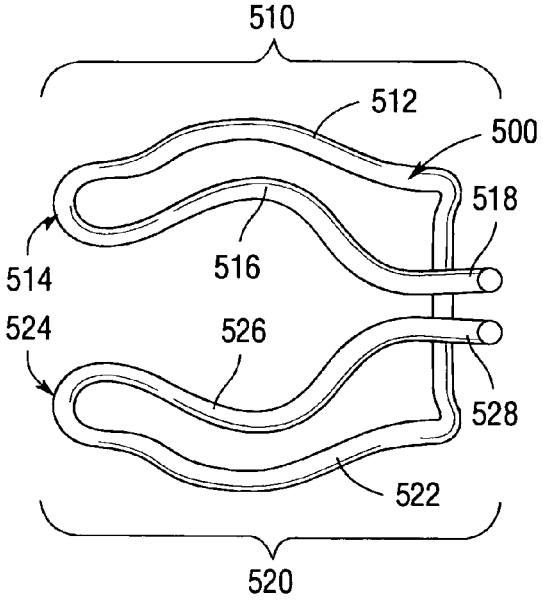
FIG. 24 is a plan view of another spring retainer embodiment of the subject invention.
Figure 25:
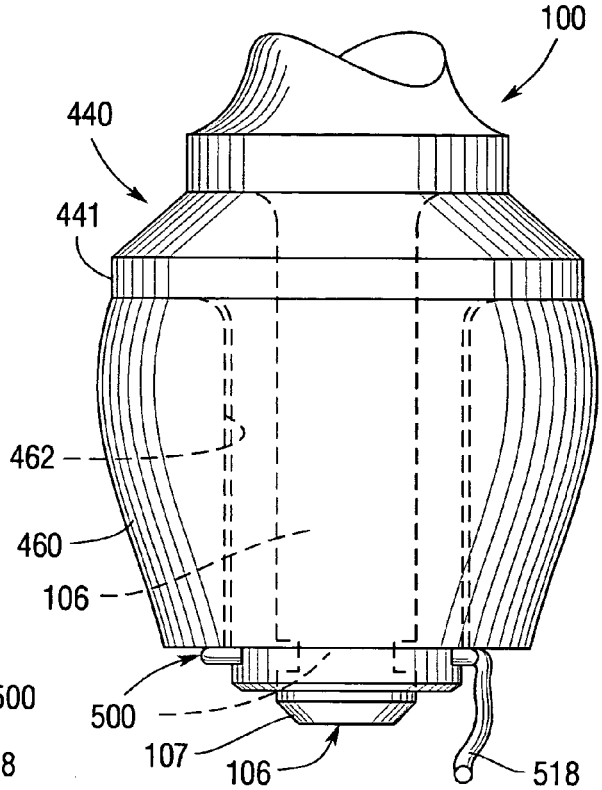
FIG. 25 is a side view of the retainer spring of FIG. 24 employed to retain a bit in a sleeve and support block embodiment of the present invention.
Figure 26:
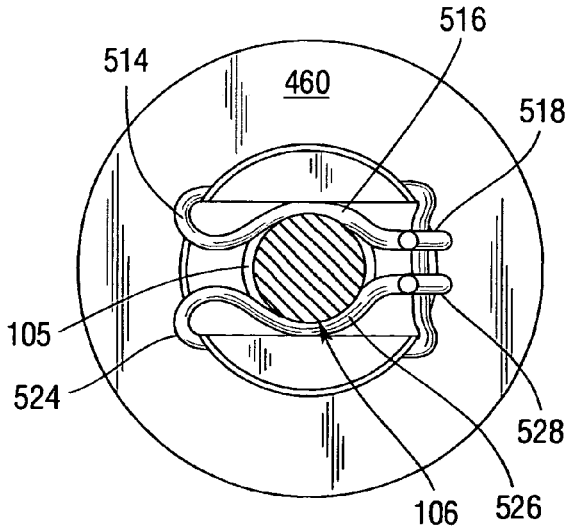
FIG. 26 is a bottom view of the spring retainer and support block arrangement of FIG. 25.

FIGS. 24-26 illustrate another retainer spring embodiment of the present invention. In this embodiment, the retainer spring 500 may be fabricated from a single piece of spring wire or the like and have first portion generally designated as 510 and a second portion generally designated as 520. The first portion 510 includes a sleeve-engaging portion 512, a first retaining node 514 and a shank-engaging portion 516. The first portion 510 also includes a first end 518. The second portion 520 may include a second sleeve-engaging portion 522, a second node or bent portion 524 and a second shank-engaging portion 526. The second portion 520 also includes a second free end 528. The retainer spring 500 may be attached to one of the sleeve embodiments described above. For example, as shown in FIG. 25, when attached to the sleeve, the first and second retaining nodes 514, 524 serve to retain the sleeve within the block 120. In this embodiment, the first shank-engaging portion 516 engages a portion of the shank 106 that is adjacent to the first retaining portion or groove 26 and the second shank engaging portion engages a portion of the shank 106 that is adjacent to the second retaining portion or groove 28.

The various embodiments of the retainer systems of the present invention provide a fast and economical means for removably detaching a cutting bit to a support block of the types employed in mining operations. Various embodiments also include means for removably supporting wear sleeves in the support blocks to provide added protection to the support blocks themselves. Various embodiments of the retainer system of the present invention also afford the bit the ability to rotate within the sleeve while remaining retained therein. Such feature is desirable to permit even wearing of the cutting insert. It will be appreciated, however, that various embodiments may be also effectively employed to removably retain a cutting bit in a support block without the use of a wear sleeve. In such embodiments, the under cut portions and retainer flanges described above would be supplied in the support block or member 120. The reader will also appreciate that the various advantages provided by the embodiments of the present invention could be successfully employed to retain a myriad of other types of cutting tools in support members without departing from the spirit and scope of the present invention.

Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A retainer system for a cutting tool having an elongated shank, the retainer system comprising:

a tool holder block having a sleeve-receiving hole therethrough;

a sleeve removably received in the sleeve-receiving hole in the tool holder block, the sleeve having a shank-receiving hole and first and second undercut portions therein; and a retainer having a first retainer portion and a second retainer portion defining a shank-receiving opening therebetween, said first retainer portion further having a first sleeve engaging portion corresponding to said first undercut portion in said sleeve for selective engagement therewith and said second retainer portion further having a second sleeve engaging portion corresponding to said second undercut portion in the sleeve for selective retaining engagement therewith, and wherein the first and second retainer portions retainingly engage a portion of the elongated shank of the cutting tool when inserted into the shank-receiving opening therebetween, the retainer having an exposed first free end and an exposed second free end such that each said first and second free end protrudes outwardly from said sleeve to be accessible from the exterior of said sleeve and said tool holder block, and such that application of a first force directly to the first free end and application of a second force directly to the second free end moves the first and second retainer portions out of biasing engagement with the cutting tool shank without disengaging said retainer from retaining engagement with said sleeve the retainer retains the sleeve within the tool holder block.

2. The retainer system of claim 1 wherein the first retainer portion includes a first shank-engaging portion and wherein the second retainer portion includes a second shank-engaging portion opposite the first shank engaging portion to define said shank-receiving opening therebetween, the first and second shank-engaging portions in biasing engagement with the shank of the cutting tool when the shank is received in the shank-receiving opening.

3. The retainer system of claim 2 wherein the first and second shank-engaging portions of the retainer are configured to be biasingly received in a retaining groove formed in the cutting tool shank when the shank is in the shank-receiving opening.

4. The retainer system of claim 2 wherein the first sleeve-engaging portion is configured relative to the first shank-engaging portion such that upon application of the first force to the first free end, the first shank-engaging portion is caused to move out of retaining engagement with the cutting tool shank and the first sleeve-engaging portion is retained in biasing engagement with the first undercut portion and wherein the second sleeve-engaging portion is configured relative to the second shank-engaging portion such that upon application of the second force to the second free end, the second shank-engaging portion is caused to move out of biasing engagement with the cutting tool shank and the second sleeve-engaging portion is retained in biasing engagement with the second undercut portion to retain the retainer in the sleeve.

5. The retainer system of claim 1 wherein the first force is applied in a first direction and wherein the second force is applied in a second direction that is opposite to the first direction.

6. The retainer system of claim 1 wherein the first and second free ends are forced away from each other to cause the first and second retainer portions to move out of engagement with the cutting tool shank.

7. The retainer system of claim 1 wherein the first retainer portion has a first node opposite the first exposed end and a second node opposite the second exposed free end.

8. The retainer system of claim 7 wherein the retainer has a primary retainer node that is transversely opposite from the first retainer node and a secondary retainer node that is transversely opposite from the second retainer node.

9. The retainer system of claim 8 wherein the sleeve has a flanged end such that the first and second nodes and the primary and secondary nodes and the flanged end of the sleeve retain the sleeve within the tool holder block when the sleeve is received within the sleeve-receiving hole in the tool holder block and the first sleeve-engaging portion is received in said first undercut portion and the second sleeve-engaging portion is received in said second undercut portion.

10. The retainer system of claim 1 wherein the sleeve has a flanged end.

11. The retainer system of claim 1 wherein the sleeve has a chamfered forward end.

12. A retainer system for a cutting tool having an elongated shank, the retainer system comprising:

a tool holder block having a sleeve-receiving hole therethrough;

a sleeve removably received in the sleeve-receiving hole in the tool holder block, the sleeve having a shank-receiving hole and first and second undercut portions therein; and a retainer having a first retainer portion and a second retainer portion defining a shank-receiving opening therebetween, said first retainer portion further having a first sleeve engaging portion corresponding to said first undercut portion in said sleeve for selective engagement therewith and said second retainer portion further having a second sleeve engaging portion corresponding to said second undercut portion in the sleeve for selective retaining engagement therewith, and wherein the first and second retainer portions retainingly engage a portion of the elongated shank of the cutting tool when inserted into the shank-receiving opening therebetween, the retainer having an exposed first end and an exposed second end, such that application of a first force to the first end and application of a second force to the second end moves the first and second retainer portions out of biasing engagement with the cutting tool shank without disengaging said retainer from retaining engagement with said sleeve, wherein the first and second ends are forced toward each other to cause the first and second retainer portions to move out of engagement with the cutting tool shank the retainer retains the sleeve within the tool holder block.

13. A retainer system for a cutting tool having an elongated shank, the retainer comprising:

a tool holder block having a sleeve-receiving hole therethrough;

a sleeve removably received in the sleeve-receiving hole in the tool holder block, the sleeve having a shank-receiving hole and at least one undercut portion therein; and means for retaining the sleeve within the tool holder block and protruding therefrom, said means for retaining selectively retaining the shank of the cutting tool within the sleeve, such that upon direct application of first and second forces to protruding free end portions of the means for retaining, the shank is released from retaining engagement with the means for retaining and the means for retaining is retained in engagement with the at least one said undercut portion in said sleeve, wherein said retaining means is accessible from the exterior of said sleeve and said tool holder block.

14. A retainer system for a cutting tool having an elongated shank, the retainer system comprising:

a tool holder block having a sleeve-receiving hole therethrough;

a sleeve removably received in the sleeve-receiving hole in the tool holder block, the sleeve having a shank-receiving hole and first and second undercut portions therein; and a retainer having a first retainer portion and a second retainer portion defining a shank-receiving opening therebetween, said first retainer portion further having a first sleeve engaging portion corresponding to said first undercut portion in said sleeve for selective engagement therewith and said second retainer portion further having a second sleeve engaging portion corresponding to said second undercut portion in the sleeve for selective retaining engagement therewith, and wherein the first and second retainer portions retainingly engage a portion of the elongated shank of the cutting tool when inserted into the shank-receiving opening therebetween, the retainer having an exposed first end and an exposed second end that are accessible from the exterior of said sleeve and said tool holder block, such that application of a first force to the first end and application of a second force to the second end moves the first and second retainer portions out of biasing engagement with the cutting tool shank without disengaging said retainer from retaining engagement with said sleeve, the first retainer portion having a first node opposite the first exposed end and a second node opposite the second exposed end and a primary retainer node that is transversely opposite from the first retainer node and a secondary retainer node that is transversely opposite from the second retainer node, said sleeve further having a flanged end such that the first and second nodes and the primary and secondary nodes and the flanged end of the sleeve retain the sleeve within the tool holder block when the sleeve is received within the sleeve-receiving hole in the tool holder block and the first sleeve-engaging portion is received in said first undercut portion and the second sleeve-engaging portion is received in said second undercut portion.

* * * * *